US006030330A

United States Patent [19]

Diehl

[11] Patent Number: 6,030,330

[45] Date of Patent: Feb. 29, 2000

[54] PAPER ROLL WIDTH REDUCTION

[75] Inventor: Lawrence A. Diehl, Lititz, Pa.

[73] Assignee: R. R. Donnelley & Sons Company, Chicago, Ill.

[21] Appl. No.: 09/006,606

[22] Filed: Jan. 13, 1998

[51] Int. Cl.[7] ..... B31B 49/00

[52] U.S. Cl. ..... 493/355; 493/357; 493/399; 83/332

[58] Field of Search ..... 493/355, 399, 493/404, 357, 358, 359, 360; 83/332

[56] References Cited

U.S. PATENT DOCUMENTS

| | | | |
|---|---|---|---|
| 3,843,113 | 10/1974 | Schaffer | 270/61 |
| 5,144,874 | 9/1992 | Garrett | 83/332 |
| 5,230,268 | 7/1993 | Richter | 83/303 |
| 5,535,996 | 7/1996 | Dancause | 270/6 |

*Primary Examiner*—Eugene L. Kim
*Attorney, Agent, or Firm*—Fitch, Even, Tabin & Flannery

[57] ABSTRACT

A method and apparatus are provided for producing a signature having a backbone fold defining a closed end and an intermediate fold transverse to the backbone fold using a reduced width of paper coming from a roll. The method and apparatus reduce gusset wrinkles adjacent the folds by slitting ribbons formed from the paper web along a trail edge and a lead edge of a closed end forming the signature. Preferably, the slitting operation leaves an uncut portion of the closed end of the signature extending across the intermediate fold from a side edge to the trail edge to stabilize the ribbon at the area to receive the intermediate fold. The lead edge and trail edge are slit very substantially to expose long areas of fibers for gluing to form a book backbone.

20 Claims, 2 Drawing Sheets

PAPER ROLL WIDTH REDUCTION

BACKGROUND OF THE INVENTION

The present invention is generally directed to the forming of signatures to be gathered on a binding line from a roll of paper that is narrower than presently used, and more particularly, to an apparatus and method for producing these signatures of a closed end type that also have less wrinkles therein.

In the production of signatures, a plurality of webs are printed on one or more presses and cut into ribbons to be utilized in forming the signatures. The ribbons are typically delivered to a common point for ribbon merger after the webs have been printed on the presses. By merging the ribbons at the common point, a composite is provided which is then utilized in forming the signatures for gathering on a bindery line. An improvement reducing the required width of the original roll of paper, but still able to produce the webs and ribbons as described herein, can potentially result in substantial dollar savings as well as a reduction in generated waste paper. However, there are significant problems inherent in the environment of the press room and bindery in terms of material handling systems. It is especially important that any attempt to reduce the width of the original roll of paper take into consideration the manner in which signatures are handled in both settings, the press room and the bindery. More to the point, the signature must remain stable, if they are to be capable of being handled by automatic material handling systems.

There are presently much wider width presses in service that produce large counts for individual signatures. For example, the average page count per signature is up from 48 pages several years ago to 64 pages today. Therefore, making such a reduction in paper usage becomes even more desirable.

One problem with folding wide width paper webs into folded webs which are merged at a common point is that of reducing gusset wrinkles adjacent the folds. Dancause U.S. Pat. No. 5,535,996 is directed to solving the problem of how to reduce gusset wrinkles. The present invention is directed to reducing the width of paper web while still producing signatures that are substantially free of gusset wrinkles.

SUMMARY OF THE INVENTION

In accordance with the present invention, signatures having a backbone fold defining a closed end are formed from a narrower width roll of paper than used heretofore. This is achieved by slitting the ribbons formed from the web in a trail edge and a lead edge of the closed end forming the signature. In the preferred method, substantially all of the lead edge is slit and a majority of the trail edge is slit. Preferably, the slitting operation leaves an uncut portion of the closed end of the signature extending across the intermediate fold from the side edge to the trail edge to stabilize the ribbon at the area to receive the intermediate fold. The lead edge and trail edge are slit very substantially to expose long large areas of fibers for glue to enter when the signatures are joined together for gluing to form a backbone of what eventually becomes a book. Because of this large slitting prior to forming the intermediate fold only a very slight cut by a saw blade is used to remove the small uncut portions on the lead edge and the trail edge. A light kissing cut is preferred. Previously, the saw cut removed a wide cut of about 3/16-inch from the lead and trail edges to expose the fibers and pages for gluing. By way of example only, if a press is using eight ribbons the savings from reducing the back trim by 1/8-inch can reach almost an inch in reducing the width for the paper roll.

Accordingly, the present invention is directed to an apparatus for producing a signature from a narrower roll of paper-which is wrinkle-free and of the type having a backbone fold defining a closed end and an intermediate fold transverse to the backbone fold with a lead edge forward of the intermediate fold and a trail edge rearward of the intermediate fold. The apparatus includes a press for printing a plurality of webs to provide ribbons to be utilized in forming the signatures, means for delivering the ribbons after the webs have been printed on the press to a common merger point, and means for merging the ribbons at a common merger point to form a composite for forming the signatures. The apparatus also includes means for folding the composite in order to form the backbone folds defining the closed ends of the signatures, means for cutting the composite into individual signatures before or after forming the backbone fold, and means for folding the individual signatures cut from the composite to form the intermediate folds. With this arrangement, the apparatus also includes means for slitting the ribbons before or after the ribbons have been merged to form the composite in such a manner as to result in a slit in at least a portion of the closed ends after forming the signatures and, preferably, accomplishing this by timed slitting of the ribbon composite after the printed ribbons have been merged.

More specifically, the time slitting of the ribbon composite is advantageously accomplished after forming the ribbon composite, but before folding to form the backbone folds or the intermediate folds.

In the example embodiment, the cutting means includes means for cutting at least a portion of the lead edge of the signatures, as well as a portion of the trail edge of the signatures. It is particularly advantageous for this to be accomplished by cutting substantially the entirety of what is to become the lead edge, but only a majority of what is to become the trail edge of the signatures. This is done by cutting through all of the printed ribbons which have been merged to provide the ribbon composite. For this purpose, the apparatus preferably includes a wheel mounted for rotation on a shaft and having a first blade and a second blade only on a portion of the circumference thereof.

In another respect, the invention is directed to a method of producing a signature from a narrower roll of paper which is wrinkle-free and which includes the steps of printing a plurality of webs on one or more presses to provide ribbons to be utilized in forming the signatures. The method also includes the steps of delivering the ribbons after the webs have been printed on the presses to a common point for ribbon merger and merging the ribbons at the common point to provide a composite to be utilized in forming the signatures. The method further includes the steps of folding the composite in order to form backbone folds defining closed ends of the signatures, cutting the composite into individual signatures before or after folding to form the backbone folds, and again folding the individual signatures cut from the composite in order to form intermediate folds. With these steps, the method still additionally includes the step of slitting the ribbons before or after the ribbons have been merged to provide a slit in at least a portion of the closed ends after forming the signatures. In accordance with the invention, the step of slitting the ribbons includes cutting at least a portion of the lead edge as well as the trail edge thereof. Still more specifically, the slitting step includes cutting substantially the entirety of the lead edge of the closed end and a majority of the trail edge of the closed end of the signatures before the composite is folded to form the backbone folds. Advantageously, the step of slitting the ribbons is performed by timed slitting of the composite after the ribbons have been merged.

Preferably, the timed slitting of the ribbon composite is performed before folding, to form the backbone folds or the intermediate folds, by using a wheel mounted for rotation on a shaft and having a first blade and a second blade only on a portion of the circumference thereof.

In still another respect, the present invention is directed to a slitting apparatus for slitting a signature of the type having a backbone fold defining a closed end and an intermediate fold transverse to the backbone fold with a lead edge forward of the intermediate fold and a trail edge rearward of the intermediate fold, in order to produce a signature from a narrower roll of paper which is wrinkle-free. The slitting apparatus comprises a roller mounted on a shaft for rotation to receive a plurality of printed ribbons at a common merger point in order to provide a ribbon composite for forming the signatures, and a slitter wheel mounted on a shaft for rotation for timed slitting of the ribbon composite after the printed ribbons have been merged to form the ribbon composite. Still additionally, the shafts of the roller and slitter wheel are disposed in generally parallel relation with the slitter wheel having a first blade and a second blade in confronting relation to the roller on only a portion of the circumference where the remainder of the circumference is radially reduced relative to the blade.

For an example, in the embodiment of the slitting apparatus, the first blade and the second blade include an upstream end and a downstream end when considered generally in the direction of rotation of the slitter wheel. The upstream end advantageously has a radius leading to the blade edge from the radially reduced portion of the slitter wheel circumference and the slitter wheel also has a pair of parallel faces perpendicular to the shaft of the slitter wheel. With this arrangement, the first blade and the second blade are defined by a surface extending at an acute angle from one of the faces to the other of the faces to form a generally V-shaped blade edge.

By having the final arrangement of the individual signatures now with slits in both the lead edge and the trail edge, it becomes apparent that when these signatures are joined for gluing in order to form the backbone of what will eventually be the book, most of the pages are exposed for the glue to enter. Therefore, a very slight cut by a saw blade, a "kissing" if you will, can remove the remainder of the trail edge and lead edge of the closed end that has not been slit, thereby allowing glue to enter all the pages and making a secure backbone for the finished book. In doing this, the savings are apparent because in previous manufacture there were no slits in the backbone, and approximately 3/16-inch was cut from the backbone in order to expose all the individual pages. Approximately, 1/8-inch now can be saved in less generated waste, but more specifically, the width of the original roll of paper can now be reduced by as much as 1-inch or more in the sense that many of the presses now are using 8 ribbons or more.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
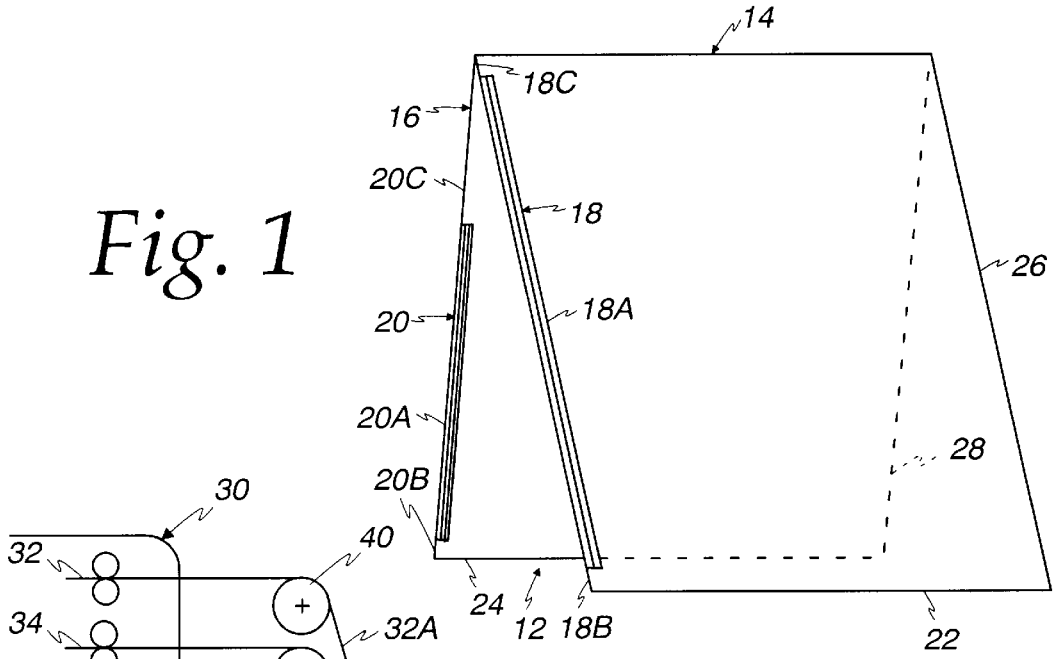
FIG. 1 is a perspective view of a closed end signature that has been produced from a roll of paper with reduced width so as to be wrinkle-free in accordance with the present invention.
Figure 2:
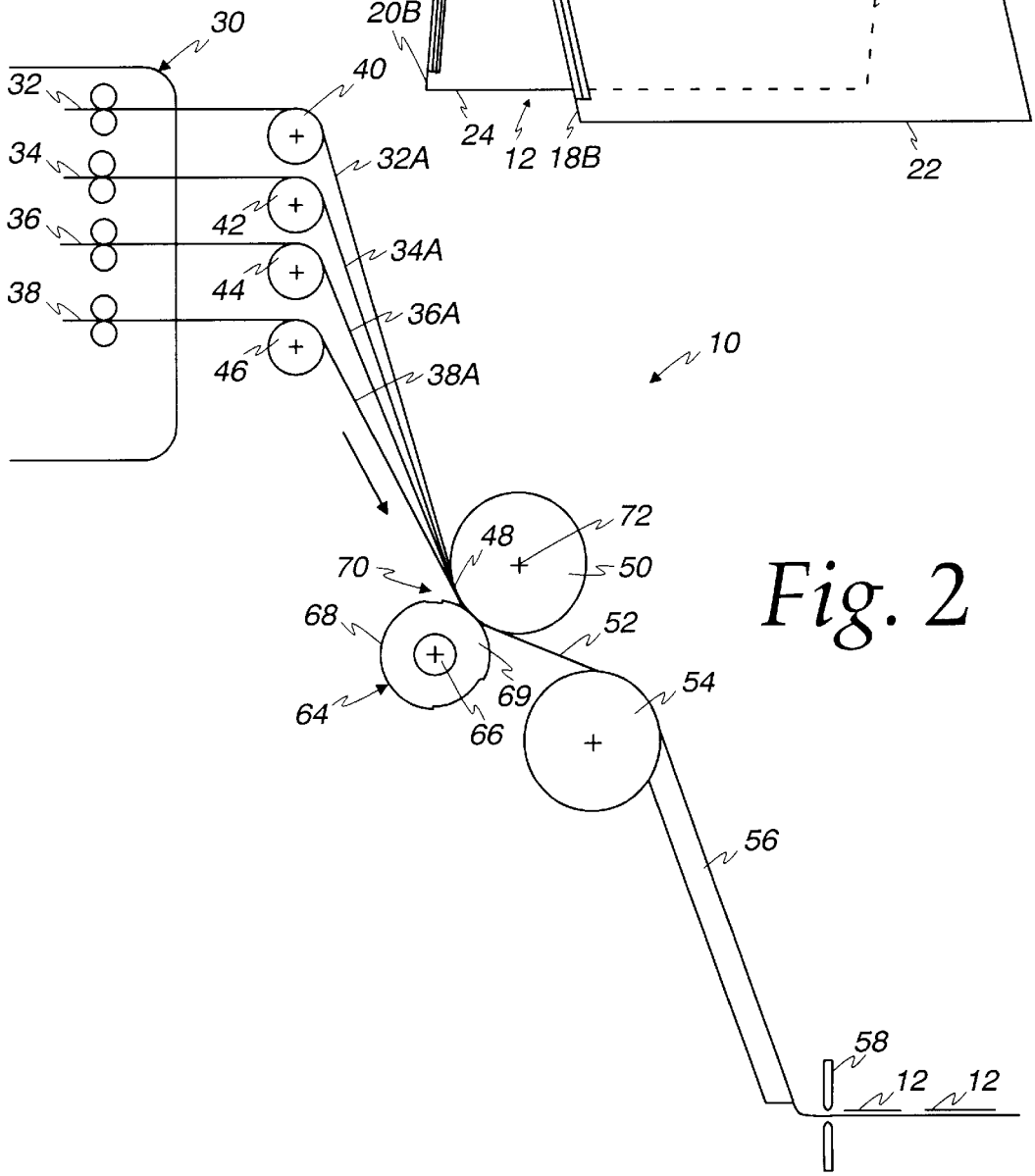
FIG. 2 is a schematic view illustrating an apparatus for producing the wrinkle-free signature from a reduced width roll of paper of the type such as illustrated in FIG. 1.

In the illustration given, and with reference first to FIGS. 1 and 2, the reference numeral 10 designates generally an apparatus for producing a wrinkle-free signature 12 from a roll of paper of reduced width of the type having a closed intermediate fold 14 and a closed backbone fold 16. The closed backbone fold 16 defines a closed end having a lead edge 18 forward of the intermediate fold 14 and a trail edge 20 rearward of the intermediate fold 14. As will be appreciated by specifically referring to the signature 12 as shown in FIG. 1, the remaining edges 22, 24, 26 and 28 are all open edges, i.e., they are not edges that are formed by folding. The open edge 22 defines the lead end of the signature shown in FIG. 1, and the open edge 24 defines the trailing edge of the signature.

In the illustrated embodiment, the intermediate fold 14 extend s transverse to the backbone fold 16 and comprises a head fold, although it could comprise a foot fold as well.

Figure 3:
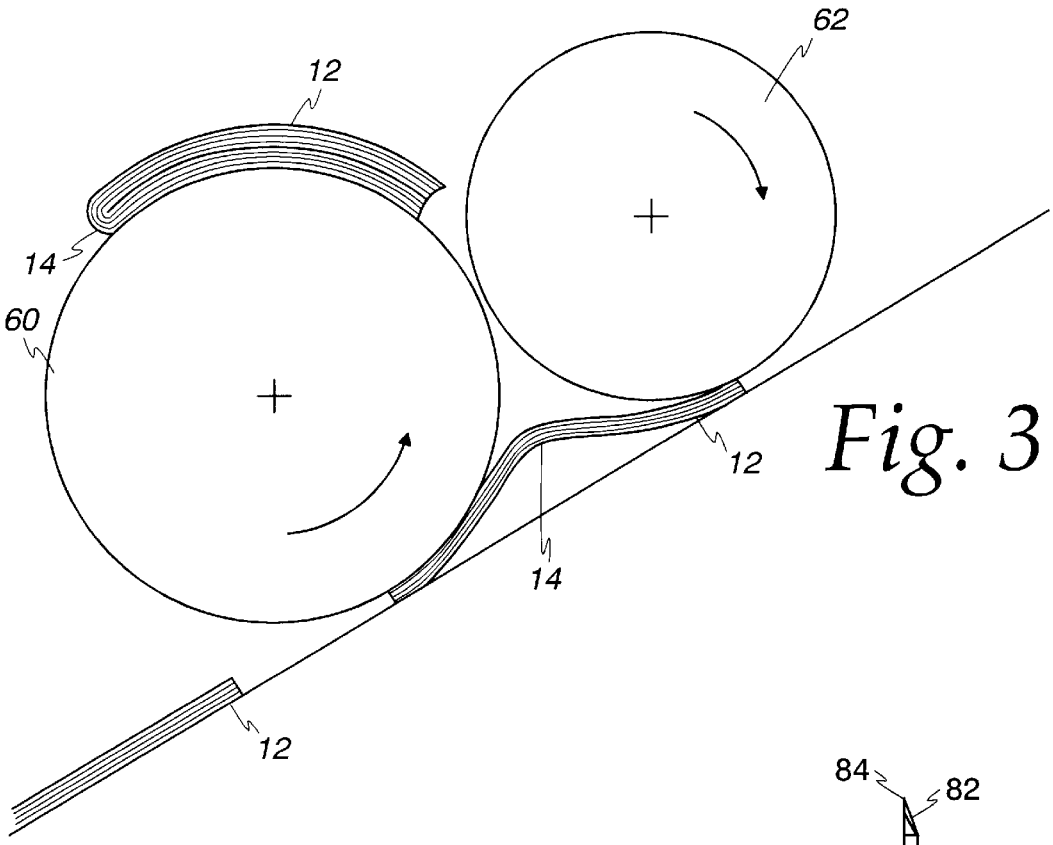
FIG. 3 is a schematic view of another portion of an apparatus for producing a closed end signature of the type such as illustrated in FIG. 1.

Turning now specifically to FIGS. 2 and 3, the apparatus 10 will be seen to include a press generally designated 30 for printing a plurality of webs such as 32, 34, 36 and 38 to provide ribbons such as 32*a*, 34*a*, 36*a* and 38*a* to be utilized in forming the signatures 12. It will also be seen that the apparatus 10 includes means such as the power-driven rollers 40, 42, 44 and 46 for delivering the ribbons such as 32*a*, 34*a*, 36*a* and 38*a* to a common merger point 48. With this arrangement, the apparatus 10 also will be seen to include means such as the power-driven roller 50 for merging the ribbons 32*a*, 34*a*, 36*a* and 38*a* at the common merger point 48 so as to form composite ribbons 52 to be utilized for forming the signatures 12.

Still referring to FIGS. 2 and 3, the apparatus 10 includes means such as the roller top 54 and the former board 56 for folding the composite ribbons 52 in order to form the backbone folds 16 defining the closed ends of the signatures 12. It would still further be seen from FIGS. 2 and 3 that the apparatus 10 includes means such as a cutter 58 for cutting the composite ribbons 52 before or, preferably, after forming the backbone fold 16 so as to create individual ones of the signatures 12. Referring specifically to FIG. 3, the apparatus 10 further includes means such as the collect cylinder 60 and the jaw cylinder 62 for folding the individual ones of the signatures 12 cut from the composite ribbons 52 to form the intermediate folds 14.

As for the specifics of the press 30, drive rollers 40, 42, 44, and 46; drive roller 50, roller top 54, former board 56, cutter 58, collect cylinder 60 and jaw cylinder 62, can all take the form of one or more of the various commercially available devices that are presently utilized in the industry for producing signatures, particularly of the head fold type having a backbone fold 16 defining a closed end with a lead edge 18 forward of the head fold 14 and a trail edge 20 rearward of the head fold 14.

Referring once again to FIG. 2, the apparatus 10 will be seen to still additionally include means for slitting the ribbons 32*a,* 34*a,* 36*a* and 38*a* before, or preferably, after they have been merged to form the composite ribbons 52 in such manner as to result in two slits in at least two portions of the closed end 16 of the signatures 12 before forming the intermediate or head folds 14. This advantageously takes the form of a slitter wheel generally designated 64 which is mounted for rotation on a shaft 66 and has a first blade 68 and a second blade 69 on two portions of the circumference thereof. Preferably, the slitter wheel 64 produces timed slitting of the ribbon composite 52 after the printed ribbons 32*a,* 34*a,* 36*a* and 38*a* have been formed into the ribbon composite 52, but before forming either of the folds 14 and 16.

Timed slitting of the ribbon composite means that the circumference of the slitting wheel 64 is equal to the length of the entire signature 12 from edge 22 to edge 24 as shown in FIG. 1. Therefore, the slitting wheel 64 makes a complete 360° revolution for each complete ribbon composite 52 which will be separated into signatures 12 and the slitting wheel 64 is timed so that the slits 18*a* and 20*a* will be located as shown in FIG. 1 for each signature 12.

Referring to FIGS. 1 and 2, the cutting means or slitter wheel 64 will be understood to include means such as the first slitting blade 68 which is adapted to cut through the ribbons 32*a,* 34*a,* 36*a* and 38*a* along at least a portion 18*a* of the lead edges 18 of the signatures 12, and to include means such as the second slitting blade 69 which is adapted to cut through the ribbons 32*a,* 34*a,* 36*a* and 38*a* along at least a portion 20*a* of the trail edges 20 of the signatures 12. It will be seen from FIG. 1 that this preferably includes cutting substantially the entirety of the lead edges 18 leaving only a relatively small unslit area 18*b* adjacent the edge 22, and a similarly relatively small unslit area 18*c* adjacent the fold 14. For this purpose, the blade 68 is adapted to cut through all of the printed ribbons 32*a,* 34*a,* 36*a,* and 38*a* in the portions 18*a* of the lead edges 18, the ribbons which are merged to provide the ribbon composite 52.

Also referring to FIG. 1, this also includes cutting substantially a majority of a trail edge leaving only a relatively small unslit area 20*b* adjacent the edge 24 and a relatively large unslit area 20*c* adjacent the fold 14. For this purpose, the blade 69 is adapted to cut through all of the printed ribbons 32*a,* 34*a,* 36*a* and 38*a* in the portions 20*a* of the trail edges 20 of the ribbons which are merged to provide the ribbon composite 52.

As will now be appreciated, the present invention utilizes the concept of using two timed slits to eliminate first, gusset wrinkles in the closed end signature 12, and second, to allow the purchase of a narrower width paper web at lower cost then presently possible. The two timed slits are located on what becomes the lead edge 18 of signature 12 and the trail edge 20 of signature 12, and preferably are produced before the ribbons 32*a,* 34*a,* 36*a* and 38*a* travel across the roller top 54 and former board 56. For this purpose a modified circular blade in the form of the slitter wheel 64 is advantageously located just upstream of the roller top 54.

With the present invention, the two timed slits could possibly be accomplished elsewhere depending upon equipment layout. It is important, however, for the two timed slits to be in proper relation to the cutoff of the composite ribbons 52 into individual signatures 12 in order for the two slits to be at the desired location along the lead edge 18 and trail edge 20 of the signatures 12. In other words, the timing is important in order to control the length of the unslit areas. The present invention has two purposes: one is to eliminate the problem of gusset wrinkles and the second purpose is to allow a purchase of less paper, thereby a savings, and this also results in the reduction of paper waste.

We will first discuss the purpose of eliminating gusset wrinkles and then we will discuss how the paper savings are generated.

In the present invention, the lead edge 18 of the signature 12 was slit so as to form an unslit area 18*b* of a length of approximately ½-inch and so as to form an unslit area 18*c* of a length of approximately ⅛-inch. These areas are advantageously unslit because of conditions existing with available equipment and it has been found that the ½-inch unslit area 18*b* allows for stability in the press room, both in the automated material handling systems and by the press operators, while the ⅛-inch unslit area 18*c* provides stiffness at the head of the signature to allow the binding equipment (more specifically the "gatherer" area of the bindery equipment) to handle each signature without generating top page tears at the signature. Moreover, it has been discovered in practice that wherever an unslit area begins at the head of the signature, for example, an unslit area such as 18*c,* that is where a gusset wrinkle will occur. By selecting the length of the unslit area 18*c* at the head of the signature to be relatively smaller than an inch, such as ⅛-inch, it has been found that this is a preferred measurement with present equipment due to the fact that this portion of the signature is held in place by the moving jaws of the jaw cylinder 62. As for selecting the length of the unslit area 18*b* at the foot of the signature, to be of an also relatively small dimension such as ½-inch, it has been found that this does in fact generate a gusset wrinkle, but the binding process eliminates it by trimming off this area of the signature.

Ideally, the entire lead edge 18 of the signature 12 would be slit in order to eliminate any wrinkle at any point in the process, but this is not possible with much if not all of the existing bindery equipment.

By slitting the lead edge 18 of the signature 12, the gusset wrinkles are eliminated by allowing air to escape from the signatures 12 while also allowing for a smoother transition of the signature 12 through the folding equipment. This combination of trapped air, together with operation of the folding equipment, has in the past generated the gusset wrinkles. Because the lead edge 18 of the signature 12 is slit, that portion of the signature 12 becomes very pliable or free-flowing, while also allowing trapped air to escape to accomplish a smooth transfer through the folding equipment.

Now we will discuss the purpose of slitting the trail edge 20. Prior to this invention, the signatures 12 were slit only on the lead edge 18 as described and then sent to the bindery operation to be gathered along with other signatures 12 in order to form a book. This was accomplished by gathering all the signatures, stacked one above the other, and then, while holding these signatures in place, trimming the closed backbone fold 16 by approximately 3/16-inch in order to expose the individual sheets comprising the signatures 12. This was done for the purpose of exposing fibers to receive sufficient glue penetration and then applying the cover of the book, whereby this glued section formed the backbone of the completed book.

In the present invention, the trail edge 20 and the lead edge 18 of the closed backbone fold 16 are both slit at 18*a* and 20*a,* respectively, as shown in FIG. 1. The slitting of the lead edge 18 solves the gusset wrinkle problem. However, the slit 20*a* of the trail edge allows the eventual bindery operation of trimming the closed backbone fold 16 by approximately 3/16-inch to change to merely scoring this backbone fold 16 instead of trimming. Since the majority of the backbone fold 16 is already slit and the individual pages are already exposed, a slight scoring process will open up and expose the fibers at the remainder of each page at the backbone fold 16, thereby reducing the amount of paper required by approximately 1/8-inch per ribbon. Because most of the backbone is already cut, only a light cut to true the edge to receive the glue and to remove the backbone fold portions 18*b,* 18*c,* 20*c* and 20*b* is required. This very light cut could be termed a "kiss cut." Because of the folds, the savings of the 1/8-inch cut per ribbon is multiplied to amount to approximately ½-inch or more in the overall width of the original roll of paper. This reduction of width obviously results in a reduced cost of the original roll of paper, as well as reduced waste in the bindery trimming operations.

Figure 4:
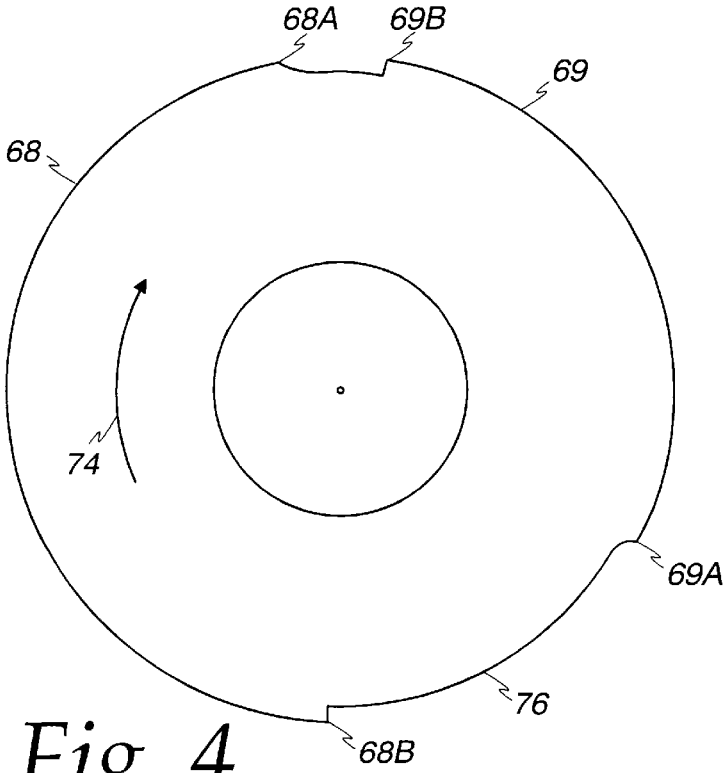
FIG. 4 is a front elevational view of the first blade and the second blade for the apparatus such as illustrated in FIG. 2.
Figure 5:
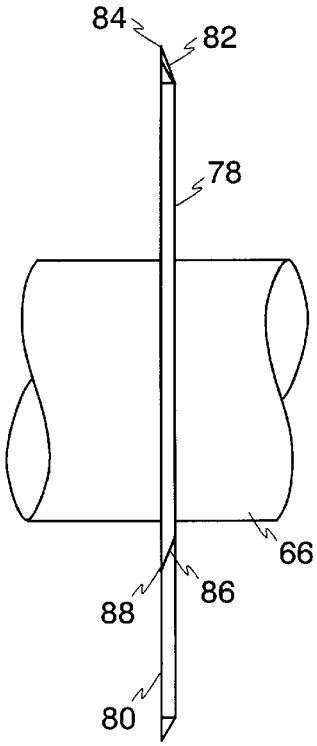
FIG. 5 is an end elevational view of the first blade and the second blade such as illustrated in FIG. 4.

Referring to FIGS. 2, 4 and 5, the present invention will also be understood in another sense as being directed to a slitting apparatus 70 for cutting a signature 12 of the type previously described in order to enjoy the savings inherent through using narrower paper webs which means less scrap and resulting savings, and also in order to produce a wrinkle-free signature. The slitting apparatus 70 will be seen as comprising the drive roller 50 which is mounted on a shaft 72 for rotation to receive the plurality of printed ribbons 32*a,* 34*a,* 36*a* and 38*a* at the common merger point 48, to provide the ribbon composite 52 for forming signatures 12, and also comprising the slitter wheel 64 mounted on the shaft 66, for rotation for timed slitting of the ribbon composite 52 after the printed ribbons 32*a,* 34*a,* 36*a* and 38*a,* have been merged to form the ribbon composite 52. As shown in FIG. 2, the respective shafts 66 and 72 of the slitter wheel 64 and drive roller 50 are disposed in generally parallel relation with the first blade 68 and the second blade 69 in confronting relation to the drive roller 50 on only two portions of the circumference thereof.

Referring specifically to FIG. 4, it will be seen that the remainder of the circumference of the slitter wheel 64 be radially reduced relative to the first blade 68 and the second blade 69.

Referring now to FIGS. 4 and 5, the first blade 68 and the second blade 69 both include an upstream end 68*a* and 69*a* respectively, and a downstream end 68*b* and 69*b,* respectively, in the direction of rotation of the slitter wheel 64, which is represented by the arrow 74. The upstream ends 68*a* and 69*a* will be seen to have a radius leading to the first blade 68 and second blade 69 from the radially reduced portions 76 of the circumference of the slitter wheel 64, and the slitter wheel 64 will also be seen to have a pair of generally parallel faces 78 and 80, which are disposed generally perpendicular to the shaft 66 thereof, as best illustrated in FIG. 5. It is also shown in FIG. 5 that the first blade 68 is defined by a surface 82 extending at an acute angle from one of the faces 78 to the other of the faces 80 to form a generally V-shaped blade edge 84. Also, the second blade 69 is defined by a surface 86 extending at an acute angle from one of the faces 78 to the other of the faces 80 to form a generally V-shaped blade edge 88.

In another respect, the present invention is directed to a method of producing from a reduced width roll of paper, a wrinkle-free signature 12 of the type having an intermediate fold 14 and a backbone fold 16 defining a closed end with a lead edge 18 forward of the intermediate fold 14 and a trail edge 20 rearward of the intermediate fold 14. The method includes the steps of printing a plurality of webs 32, 34, 36 and 38 on a press 30 to provide ribbons 32*a,* 34*a,* 36*a* and 38*a* to be utilized in forming the signatures 12, delivering the ribbons 32*a,* 34*a,* 36*a* and 38*a* after the webs 32, 34, 36 and 38 have been printed on the press 30 to a common point 48 for ribbon merger and merging the ribbons 32*a,* 34*a,* 36*a,* 38*a* at the common point 48 to form a composite ribbon 52 to be utilized in forming the signatures 12; and slitting both the lead edge 18 and trail edge 20 leaving unslit portions in both the lead edge 18 and trail edge 20. The method also includes the steps of the folding the composite ribbons 52 in order to form the backbone fold 16, defining the closed ends of the signatures 12, cutting the composite ribbons 52 into individual ones of the signatures 12 before or after folding to form the backbone fold 16, and folding the individual ones of the signatures 12 cut from the composite ribbons 52 in order to form the intermediate folds 14. With this arrangement, the method still additionally includes the step of slitting the ribbons 32*a,* 34*a,* 36*a* and 38*a* before or after they have been merged to form the composite ribbons in such a manner as to result in a lead unslit area 18*b,* a long slit area 18*a,* a center, unslit intermediate fold area 18*c* and 20*c,* another slit area 20*a,* and an unslit trail edge area 20*b* comprising a backbone fold 16 after forming the signatures 12.

Advantageously, the timed slitting occurs after the printed ribbons 32*a,* 34*a,* 36*a,* and 38*a* have been merged to form the ribbon composite 52, but before folding to form the backbone fold 16 or the intermediate head fold 14.

Still additionally, the step of slitting the ribbons 32*a,* 34*a,* 36*a,* and 38*a* will advantageously be understood as including the cutting of at least two portions; a portion of the lead edges 18 and the trail edges 20 of the signatures 12 and, preferably cutting substantially the entirety 18*a* of the lead edges 18 thereof and a majority 20*a* of the trail edges 20 thereof. Furthermore, the step of cutting advantageously includes cutting through all of the printed ribbons 32*a,* 34*a,* 36*a,* and 38*a* which have been merged by using a slitter wheel 64 mounted for rotation on a shaft 66 and having a first blade 68 and a second blade 69 only on a first portion and a second portion of the circumference thereof.

While in the foregoing there has seen set forth a preferred embodiment of the invention, it will be appreciated that the details herein given may be varied by those skilled in the art without departing from the true spirit and scope of the appended claims.

What is claimed is:

1. A method of producing, from a reduced width roll of paper, at least one signature of the type having a backbone fold defining a closed end and an intermediate fold transverse to the backbone fold with the backbone fold having a lead edge forward of the intermediate fold and a trail edge rearward of the intermediate fold, comprising the steps of:

printing on a plurality of webs on a press to provide ribbons to be utilized in forming the signature;

delivering the ribbons after the webs have been printed on the press to a common point for ribbon merger;

merging the ribbons at the common point to form a composite to be utilized in forming the signature;

folding the composite in order to form the backbone fold, defining the closed end of the signature;

cutting the composite into the signature before or after folding to form the backbone fold;

folding the signature cut from the composite in order to form the intermediate fold; and slitting the ribbons before or after the ribbons have been merged to form the composite with slits in a lead edge and a trail edge of the closed end after forming the signature.

2. The method of claim 1 wherein the step of slitting the ribbons includes cutting the lead edge of the closed end of the signature as well as cutting the trail edge of the closed end of the signature; and leaving an uncut portion extending across the intermediate fold from the lead edge to the trail edge.

3. A method in accordance with claim 2 including the steps of making a light cut of substantially less than 3/16-inch to remove the unslit areas.

4. The method of claim 1 wherein the step of slitting the ribbons includes:

cutting substantially the entirety of the lead edge of the closed end of the signature while leaving an uncut portion at what will be the lead end of the signature and an uncut portion at what will be the intermediate fold; and cutting the majority of the trail edge of the closed end of the signature while leaving an uncut portion at what will be the trailing edge of the signature and an uncut portion at what will be the intermediate fold.

5. The method of claim 1 wherein the step of slitting the ribbons includes cutting before the composite is folded to form the backbone fold.

6. The method of claim 1 wherein the step of slitting the ribbons is performed by timed slitting of the composite after the ribbons have been merged.

7. In a method for producing, from a reduced width roll of paper, at least one signature of the head fold type having a backbone fold defining a closing with the lead edge forward of the head fold and the trail edge rearward of the head fold, comprising the steps of:

printing on a plurality of webs on a press to provide printed ribbons to be utilized in forming the signature;

delivering the printed ribbons after the webs have been printed on the press through a common point for merger thereof;

merging the printed ribbons at the common point to provide a ribbon composite for forming the signature;

folding the ribbon composite in order to form the backbone fold defining the closed end of the signature;

cutting the ribbon composite into the signature after folding to form the backbone fold;

folding the signature cut from the ribbon composite in order to form the head fold;

cutting at least two separated portions at the lead edge and the trail edge of the closed end of the signature by timed slitting leaving spaced unslit portions of the ribbon composite after the printed ribbons have been merged to form the ribbon composite, but before folding to form the backbone fold or the head fold; and forming the uncut portions at what will be the intermediate fold, a leading end of the lead edge of the closed end, and a trailing end of the trail edge of the closed end of the signature formed from the ribbons.

8. The method of claim 7 wherein the step of cutting the closed end of the signature includes cutting at least a portion of the lead edge and cutting at least a portion of the trail edge thereof.

9. The method of claim 7 wherein the step of cutting the closed end of the signature includes cutting substantially the entirety of the lead edge and cutting a majority of the trail edge thereof.

10. The method of claim 7 wherein the step of cutting includes cutting on opposite sides of the intermediate fold leaving an unslit area extending across the intermediate fold into the lead edge and trail edge.

11. The method of claim 7 wherein the step of cutting includes using a wheel mounted for rotation on a shaft and having a cutting surface or a blade only on a portion of the circumference thereof.

12. An apparatus for producing, from a reduced width roll of paper, at least one signature of the type having a backbone fold defining a closed end and an intermediate fold transverse to the backbone fold with the backbone fold having a lead edge forward of the intermediate fold and a trail edge rearward of the intermediate fold, comprising:

a press for printing a plurality of webs to provide ribbons to be utilized in forming the signature;

means for delivering the ribbons after the webs have been printed on the press to a common point;

means for merging the ribbons at the common merger point to form a composite for forming the signature;

means for folding the composite in order to form the backbone fold defining the closed end of the signature;

means for cutting the composite into the signature before or after forming the backbone fold;

means for folding the signature from the composite to form the intermediate fold; and a slitter for slitting the ribbons before or after the ribbons have been merged to form the composite in such manner as to result in two separated slits in at least two portions of the closed end after forming the signature, comprising the slitter includes a first blade edge for cutting at least a portion of the lead edge and a second blade edge for cutting at least a portion of the trail edge of the closed end of the signature.

13. The apparatus of claim 12 wherein the first blade edge cuts substantially the entirety of the lead edge and the second blade edge cuts the majority of the trail edge of the closed end of the signature.

14. The apparatus of claim 12 wherein the slitter includes means for cutting before the composite is folded to form the backbone fold.

15. The apparatus of claim 12 wherein the slitter performs timed slitting of the composite after the ribbons have been merged.

16. An apparatus for producing, from a reduced width roll of paper, at least one signature of the head fold type having a backbone fold defining a closed end with a lead edge forward of the head fold and a trail edge rearward of the head fold, comprising:

a press for printing a plurality of webs to provide printed ribbons to be utilized in forming the signature;

means for delivering the printed ribbons after the webs have been printed to a common point for merger thereof;

means for merging the printed ribbons at the common point to provide a ribbon composite for forming the signature;

means for folding the ribbon composite in order to form the backbone fold defining the closed end of the signature;

means for cutting the ribbon composite into the signature after folding to form the backbone fold;

means for folding the signature cut from the ribbon composite to form the head fold; and means for cutting both the lead edge and the trail edge of the closed end of the signature by timed slitting of the ribbon composite after the printed ribbons have been merged to form the ribbon composite, but before folding to form the backbone fold or the head fold.

17. The apparatus of claim 16 wherein the means for cutting the closed end of the signature includes means for cutting at least a portion of the lead edge and cutting at least a portion of the trail edge thereof.

18. The apparatus of claim 16 wherein the means for cutting the closed end of the signature includes means for cutting substantially the entirety of the lead edge and means for cutting substantially the majority of the trail edge thereof.

19. The apparatus of claim 16 wherein the means for cutting includes a blade for cutting through all of the printed ribbons which have been merged to provide the ribbon composite.

20. The apparatus of claim 16 wherein the means for cutting includes a wheel mounted for rotation on a shaft and having cutting surface or a blade only on a portion of the circumference thereof.

* * * * *

UNITED STATES PATENT AND TRADEMARK OFFICE

CERTIFICATE OF CORRECTION

PATENT NO. : 6,030,330
DATED : February 29, 2000
INVENTOR(S) : Lawrence A. Diehl It is certified that error appears in the above-identified patent and that said Letters Patent is hereby corrected as shown below:

Claim 4, column 9,
Line 19, change "edge" to -- end --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*